United States Patent [19]

Plasky

[11] Patent Number: 4,921,186

[45] Date of Patent: May 1, 1990

[54] APPARATUS FOR USE IN WITHDRAWING YARN FROM A WOUND YARN PACKAGE

[75] Inventor: Joseph G. Plasky, Kinston, N.C.

[73] Assignee: E. I. du Pont de Nemours and Company, Wilmington, Del.

[21] Appl. No.: 384,133

[22] Filed: Jul. 21, 1989

[51] Int. Cl.[5] ..... B65H 49/02; B65H 55/00; B65H 59/06

[52] U.S. Cl. ..... 242/147 R; 242/54 R; 242/128; 242/129; 242/8; 242/159; 242/172

[58] Field of Search ..... 242/147 R, 153, 154, 242/129.8, 54 R, 130, 130.2, 131, 141, 146, 159, 172, 176, 177, 178, 128, 1

[56] References Cited

U.S. PATENT DOCUMENTS

| | | | |
|---|---|---|---|
| 441,454 | 11/1890 | Vileyn | 242/153 X |
| 1,597,844 | 8/1926 | Thompson et al. | 242/147 R |
| 2,647,704 | 8/1953 | Samler et al. | 242/128 |
| 2,797,056 | 6/1957 | Smetana | 242/147 R X |
| 3,043,536 | 7/1962 | Brame et al. | 242/128 |
| 3,212,728 | 10/1965 | Findlow | 242/128 |
| 3,284,024 | 11/1966 | Franzen | 242/128 |
| 3,437,283 | 4/1969 | Parker | 242/128 |
| 3,727,394 | 4/1973 | Greive | 57/106 |
| 3,954,181 | 9/1960 | Sawyer | 242/128 |
| 4,077,084 | 3/1978 | Benson et al. | 15/306 A |

FOREIGN PATENT DOCUMENTS

| | | | |
|---|---|---|---|
| 536552 | 12/1955 | Italy | 242/147 R |
| 1294166 | 10/1972 | United Kingdom . | |

*Primary Examiner*—Stanley N. Gilreath

[57] ABSTRACT

Apparatus for use in withdrawing yarn from a wound package in an over-end direction includes a body having a circumferential surface coaxial with the yarn package that extends beyond the bobbin upon which package is wound and touches the end of the yarn package over which the yarn is withdrawn.

3 Claims, 3 Drawing Sheets

APPARATUS FOR USE IN WITHDRAWING YARN FROM A WOUND YARN PACKAGE

BACKGROUND OF THE INVENTION

The present invention relates to textile apparatus in general and, more particularly, to an apparatus for use in withdrawing yarn from a yarn package.

In the manufacture and processing of yarn it is customary to wind yarn on a bobbin or cone in layers to form a package. The packages can have a variety of shapes including cylindrical, conical and biconical. For further treatment or processing of the yarn the yarn must subsequently be withdrawn from the package. Such withdrawal usually takes place over the end of the package in substantially the axial direction of the package. However, it has been found that there is a tendency during unwinding for the yarn to slough. More particularly, sloughing causes rings or convolutions to be pulled prematurely off the package which in turn cause snarling and/or yarn breakage. The tendency to slough can be reduced by operating at lower speeds; however, this is at the expense of productivity.

SUMMARY OF THE INVENTION

To prevent the above-noted problem and improve productivity an apparatus has been developed that simulates an extension of the bobbin on which the package is wound. The simulated extension catches the sloughed yarn and feeds it properly for further processing. More particularly, the apparatus comprises a body having a circumferential surface and an annular recess at one end to provide a telescoping fit over one end of the bobbin. The circumferential surface is coaxial with the bobbin and extends from the end wall of the package to a location beyond the end of the bobbin. The circumferential surface may be cylindrical or tapered or stepped and preferably terminates in rounded or tapered lengths at each end. The body can be fabricated of any material which will have a smooth surface and not snag the yarn. The body may be molded or machined to achieve the desired shape. The body may be hollow in the center but this is not a requirement.

DETAILED DESCRIPTION OF THE ILLUSTRATED EMBODIMENTS

Figure 1:
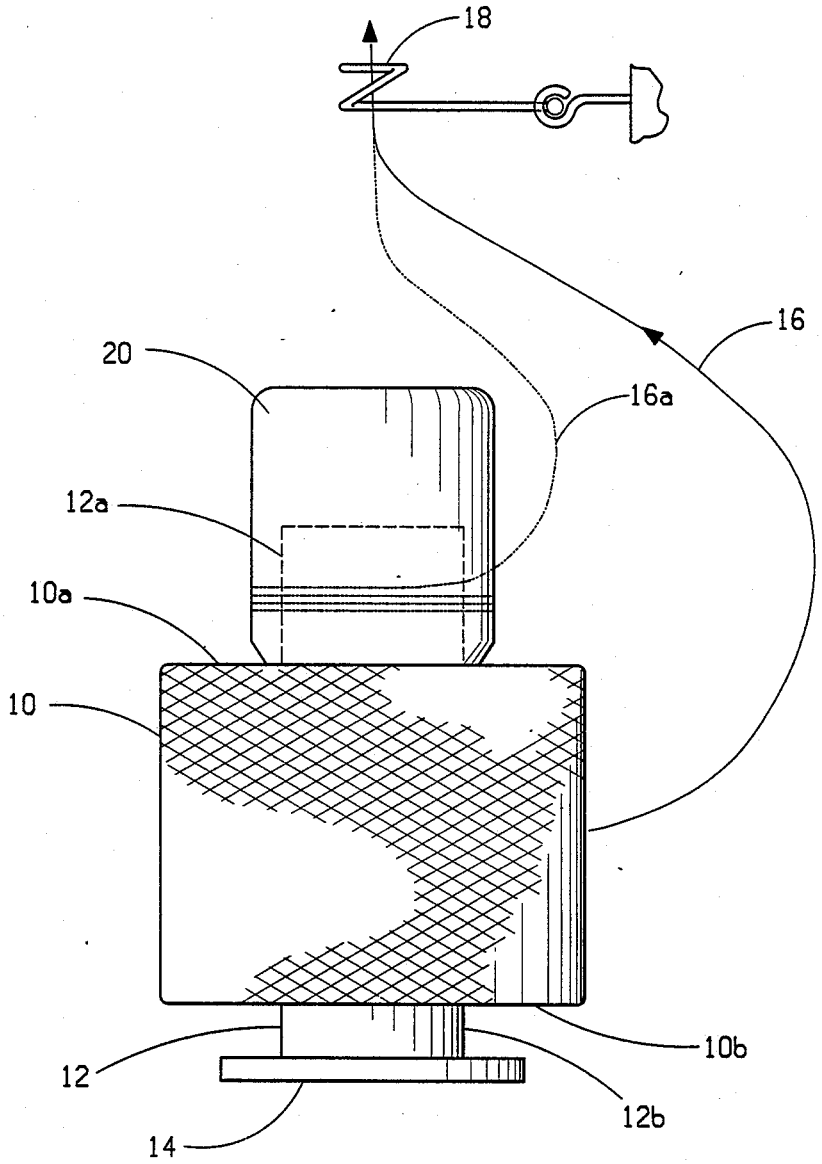
FIG. 1 is a schematic illustrating a cylindrical yarn package being unwound with the apparatus of the invention in place over one end of the bobbin on which the yarn is wound.
Figure 2:
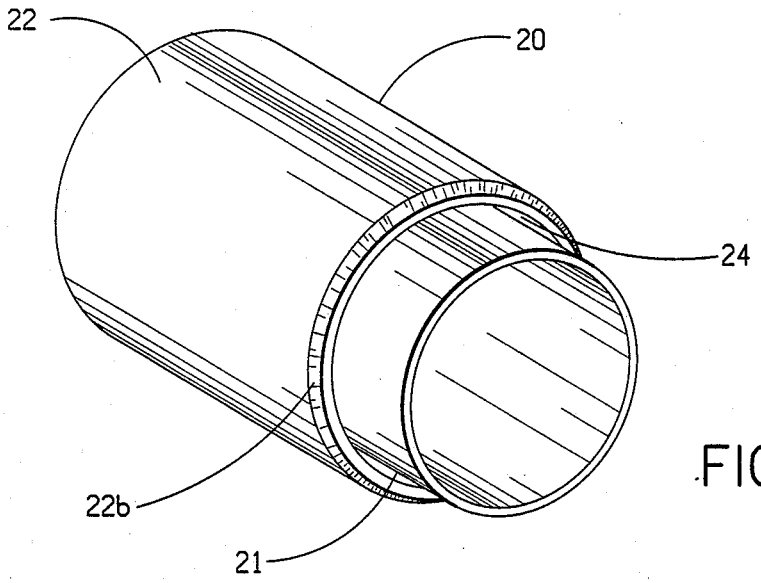
FIG. 2 is a prospective view showing the recessed end of the body of the invention that fits over the bobbin.

As best shown in FIGS. 1 and 2, the embodiment shown for purposes of illustration includes a yarn package 10 wound in layers between exposed end 12*a* and 12*b* of a bobbin 12 engaged on a support frame 14. An end of yarn 16 is being drawn over one end of the package 10 upwardly through a fixed guide eye 18 axially aligned with the package for further processing. The illustrated yarn package 10 is in the form of a cylinder with end walls 10*a* and 10*b* being substantially perpendicular to the axis of the package. A body 20 is fitted over the end 12*a* of bobbin 12. The body 20 has a circumferential surface 22 and an annular recess 24 at one end. The annular recess is between the surface 22 and inner wall 21 of the body. The circumferential surface 22 terminates in a rounded length 22*a* at one end and a tapered length 22*b* at the recessed end of the body.

Figure 3:
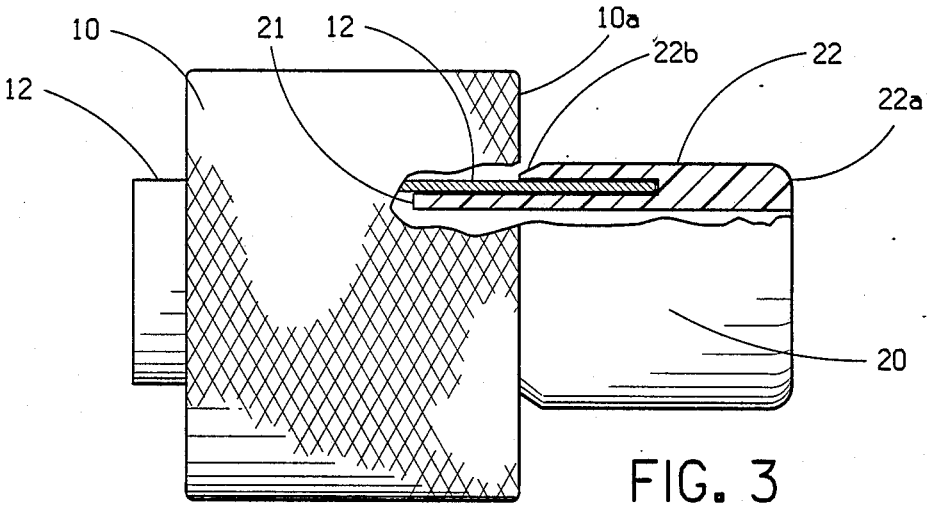
FIG. 3 shows a schematic illustration partially broken away of the body of FIG. 2 fitted onto the bobbin of yarn.
Figure 4:
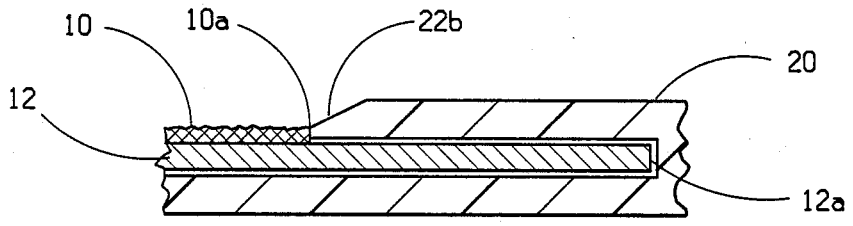
FIG. 4 is an enlarged partial view of the broken away portion of FIG. 3 with the yarn package unwound to the last few layers.

Referring now to FIGS. 3 and 4, the body 20 is shown inserted over the end of bobbin 12 in a snug telescoping fit. The circumferential surface 22 is coaxial with the bobbin 12 and touches the end wall 10*a* of the package 10 at its one end 22*b* while its other end 22*a* extends beyond the end 12*a* of the bobbin 12. Inner wall 21 of the body so extends beyond the end 22*b* of the circumferential surface into the bobbin to provide added support for the body on the bobbin.

In operation, as best shown in FIG. 1, when a slough occurs as the yarn end 16 is drawn over the end of the package, the convolutions 16*a* (shown as dashed lines) are caught by the surface of body 20 and are fed to guide 18 without entangling or snarling.

Figure 5:
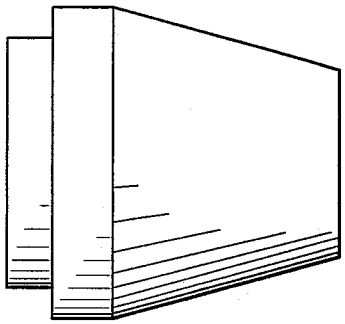
FIG. 5–7 illustrate various shapes of the body of FIG. 2 which may be useful.
Figure 6:
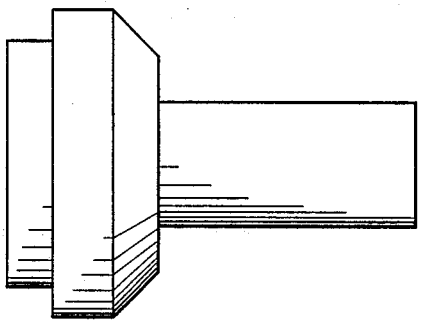
Figure 7:
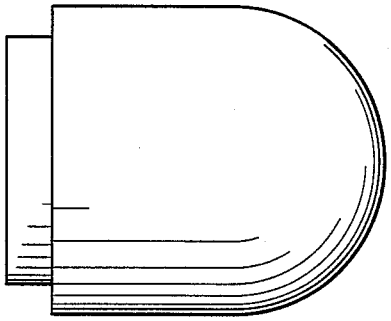

Although the preferred embodiment is in the form of a cylinder, other shapes will work as well such as a conical shaped body 20' shown in FIG. 5 or the stepped shaped body 20'' shown in FIG. 6 or the bullet-nose body 20''' shown in FIG. 7.

What is claimed is:

1. An apparatus for use in withdrawing yarn from a yarn package wound in layers between exposed ends of a bobbin, said yarn package having at least one end wall over which yarn is withdrawn, said apparatus comprising: a body having a circumferential surface and an annular recess at one end to provide a telescoping snug fit over one end of said bobbin, said circumferential surface being coaxial with said bobbin, touching said end wall of the package at one end and extending beyond the end of the bobbin at its other end.

2. The apparatus of claim 1 wherein said circumferential surface is cylindrical and terminates in rounded lengths at each end.

3. The apparatus of claim 1 wherein said circumferential surface is tapered and terminates in rounded lengths at each end.

* * * * *